US010342309B2

(12) United States Patent
Loomis

(10) Patent No.: US 10,342,309 B2
(45) Date of Patent: Jul. 9, 2019

(54) LUGGAGE WITH DYNAMIC VOLUME RECEPTACLE

(71) Applicant: Loominocity, Inc., Napa, CA (US)

(72) Inventor: Jason Loomis, Decatur, GA (US)

(73) Assignee: Loominocity, Inc., Napa, CA (US)

( * ) Notice: Subject to any disclaimer, the term of this patent is extended or adjusted under 35 U.S.C. 154(b) by 217 days.

(21) Appl. No.: 15/369,432

(22) Filed: Dec. 5, 2016

(65) Prior Publication Data

US 2017/0079397 A1 Mar. 23, 2017

Related U.S. Application Data

(63) Continuation-in-part of application No. 14/313,437, filed on Jun. 24, 2014, now abandoned.

(51) Int. Cl.

| | |
|---|---|
| ***A45C 3/00*** | (2006.01) |
| ***A45C 13/02*** | (2006.01) |
| ***A45C 5/03*** | (2006.01) |
| ***A45C 5/14*** | (2006.01) |
| ***A45C 13/26*** | (2006.01) |
| ***A45C 9/00*** | (2006.01) |
| ***A45C 5/06*** | (2006.01) |
| ***A45C 7/00*** | (2006.01) |

(Continued)

(52) U.S. Cl.

CPC ..... *A45C 13/02* (2013.01); *A45C 5/03* (2013.01); *A45C 5/06* (2013.01); *A45C 5/14* (2013.01); *A45C 7/0045* (2013.01); *A45C 9/00* (2013.01); *A45C 13/262* (2013.01); *A45C 15/00* (2013.01); *A45C 5/02* (2013.01); *A45C 2013/025* (2013.01); *A45C 2013/026* (2013.01); *A45C 2013/265* (2013.01); *A45C 2013/267* (2013.01)

(58) Field of Classification Search

CPC ..... A45C 7/0022; A45C 5/14; A45C 7/0063; A45C 7/0031; A45C 7/0027

USPC ..... 190/103, 100, 108, 109, 110, 111, 112, 190/18 A; 383/37, 101, 38; 220/23.89; 206/524.8

See application file for complete search history.

(56) References Cited

U.S. PATENT DOCUMENTS 4,236,615 A * 12/1980 Ginat ..... A45C 7/0068 190/103

5,054,589 A * 10/1991 Bomes ..... A45C 3/00 190/110

(Continued)

*Primary Examiner* — Fenn C Mathew
*Assistant Examiner* — Cynthia F Collado
(74) *Attorney, Agent, or Firm* — Craige Thompson; Thompson Patent Law

(57) ABSTRACT

Apparatus and associated methods relate to an article of luggage having a coupling interface with a plurality of support points to engage a dynamic volume receptacle (DVR). In an illustrative example, the DVR having a predetermined capacity may releasably couple to the plurality of the support points when inserted through an auxiliary aperture to form a barrier between contents inserted into a primary chamber of the luggage and contents inserted into an auxiliary chamber of the DVR. The DVR may include a capacity adjuster to permit a user to modify the predetermined capacity of the DVR. Advantageously, a user may modify the predetermined capacity prior to insertion of the DVR into the primary chamber. In some implementations, the DVR may protect the contents in the primary chamber against moisture from wet contents in the DVR, for example.

20 Claims, 20 Drawing Sheets

(51) Int. Cl.
*A45C 15/00* (2006.01)
*A45C 5/02* (2006.01)

(56) References Cited

U.S. PATENT DOCUMENTS

| | | | | |
|---|---|---|---|---|
| 5,217,119 | A * | 6/1993 | Hollingsworth | G06F 1/1628 190/102 |
| 6,499,574 | B1 * | 12/2002 | Anthony | A45C 13/008 190/102 |
| 8,210,353 | B2 * | 7/2012 | Epicureo | B65D 85/18 206/524.8 |
| 10,143,281 | B1 * | 12/2018 | Gardner | A45C 13/03 |
| 2003/0188943 | A1 * | 10/2003 | Freedman | A45C 15/00 190/112 |
| 2011/0155611 | A1 * | 6/2011 | Armstrong | A45C 7/0081 206/503 |
| 2012/0181210 | A1 * | 7/2012 | Shi | B65D 5/643 206/524.8 |
| 2013/0175130 | A1 * | 7/2013 | Liang | A45C 3/00 190/18 A |
| 2015/0089903 | A1 * | 4/2015 | Carey | A45C 13/02 53/434 |
| 2015/0366307 | A1 * | 12/2015 | Loomis | A45C 5/14 190/103 |
| 2018/0120897 | A1 * | 5/2018 | Smit | A45C 5/02 |

* cited by examiner

LUGGAGE WITH DYNAMIC VOLUME RECEPTACLE

CROSS-REFERENCE TO RELATED APPLICATIONS

This application is a Continuation-in-part and claims the benefit of U.S. application Ser. No. 14/313,437, titled "Wheeled Luggage with Telescoping Handle Framing Opposite-Side Opening Faces," filed by Jason Loomis, on Jun. 24, 2014.

This application incorporates the entire contents of the foregoing application(s) herein by reference.

TECHNICAL FIELD

Various embodiments relate generally to wheeled luggage.

BACKGROUND

Luggage is widely used by travelers worldwide. Air travelers routinely pack suitcases with clothing and necessities required for the intended trip. Clothing may be one of the most common things stowed in luggage containers by travelers. Clothing is often worn once between cleanings. Because clothing is often cleaned between wearing, much clothing may be packed when a traveler intends on traveling for more than a few days. Travelers may pack multiple copies of pants, shirts, and undergarments, for example. A traveler may pack a pair of socks for each day the traveler plans to be away.

Suitcases may be used for personal items as well. Soap, shampoo, deodorant, and toothpaste are common personal items that travelers pack. Laptop computers are another commonly carried personal item. Makeup, perfume and jewelry may be packed by travelers too. Some travelers may bring books or magazines to read to pass the time. Other people may bring music playing devices or electronic game devices with which to occupy themselves while traveling.

SUMMARY

Apparatus and associated methods relate to an article of luggage having a coupling interface with a plurality of support points to engage a dynamic volume receptacle (DVR). In an illustrative example, the DVR having a predetermined capacity may releasably couple to the plurality of the support points when inserted through an auxiliary aperture to form a barrier between contents inserted into a primary chamber of the luggage and contents inserted into an auxiliary chamber of the DVR. The DVR may include a capacity adjuster to permit a user to modify the predetermined capacity of the DVR. Advantageously, a user may modify the predetermined capacity prior to insertion of the DVR into the primary chamber. In some implementations, the DVR may protect the contents in the primary chamber against moisture from wet contents in the DVR, for example.

Apparatus and associated methods relate to substantially cuboid-shaped wheeled luggage having a U-shaped handle telescoping from two parallel secondary faces, the U-shaped handle framing two parallel primary faces each providing substantially full-face opening to one of two complementary dynamically-separated volumes of a central cavity. In an illustrative embodiment, an interior partitioning member may adaptively partition the central cavity in response to forces present to each of two sides of the interior portioning member. In some embodiments, two wheels may have axes parallel to a rolling edge defined by an intersection of a tertiary face and one of the primary faces, the wheels providing low rolling resistance when the luggage is tilted so as to rest upon the wheels. In some embodiments, a face of each of the two wheels may be substantially flush with the secondary faces. The luggage may advantageously provide separated dynamic complementary volumes for both clean clothes and dirty clothes.

Various embodiments may achieve one or more advantages. For example, some embodiments may separate clean clothes from dirty clothes. In some embodiments, the clean clothes may be preserved from the smell of the dirty clothes. For example, dirty clothes may be isolated from clean clothes by a volume allocating membrane separating two spaces. In some embodiments, a U-shaped telescoping handle may provide a sturdy lateral structure to a travel bag. The U-shaped telescoping handle may be arch shaped such that full-sized access doors may be aligned with the arch, providing access to a stowage volume unimpeded by the U-shaped telescoping handle.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, with reference to FIG. 1, a scenario in which exemplary luggage having dual full-face access to complementary volumes of a central cavity is described to disclose some of the advantages of such devices. Second, with reference to FIGS. 2A-2B, an exemplary wheeled suitcase having opposing side full-face access to a central cavity will be described. Third, with reference to FIGS. 3A-4C, operation of dynamically adjustable complementary volumes will be described. Fourth, with reference to FIG. 5, access to an interior volume using a full-face door will be described. Fifth, with reference to FIGS. 6-7, some of the advantages of a laterally affixed U-shaped handle will be discussed. Sixth, with reference to FIGS. 8A-8B, an exemplary suitcase having dual mode access will be described. Seventh, with reference to FIGS. 9A-9B, exemplary methods of dynamically partitioning a central cavity will be disclosed. Eighth, with reference to FIG. 10, exemplary suitcase geometries will be described. With reference to FIG. 11A-11B, the discussion turns to an exemplary luggage having a dynamic volume receptacle (DVR). Then, with reference to FIGS. 12-13, the DVR and its relationship to an exemplary luggage are explained. The discussion turns to various embodiments of an exemplary luggage having a DVR in FIG. 14-15. Finally, with reference to FIG. 16, the discussion turns to an exemplary luggage having a retractable support tray and an accessible battery pack.

Figure 1A:
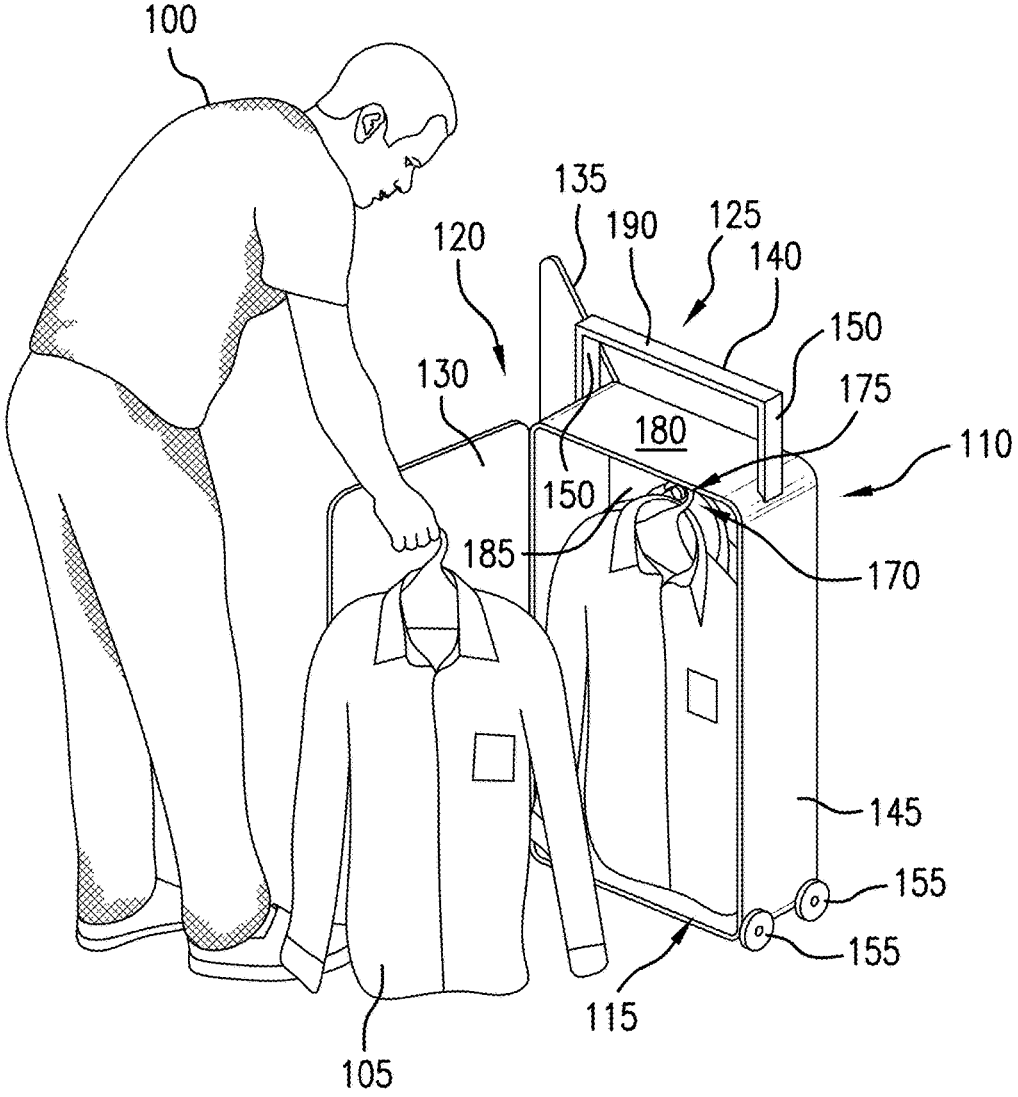
FIGS. 1A-1B depict an exemplary application of an exemplary suitcase having dual-side full face accessibility.
Figure 1B:
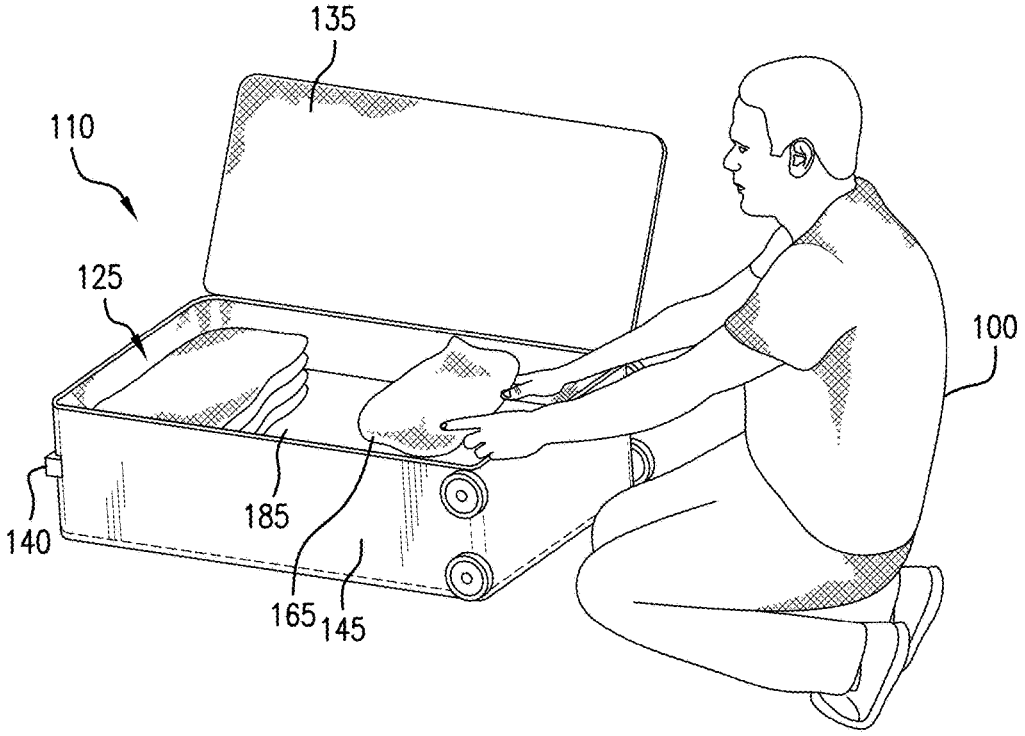

FIGS. 1A-1B depict an exemplary application of an exemplary suitcase having dual-side full-face accessibility. In FIG. 1A, a traveler 100 is removing a clean shirt 105 from an exemplary travel bag 110. The travel bag 110 has a substantially cuboid spaced main cavity 115. The main cavity 115 defines two distinct complementary volumes 120, 125 each accessed from a full-face door 130, 135 defining opposing parallel faces of the cuboid, when closed. Each of the distinct complementary volumes 120, 125 may be used for a separate purpose. For example, a first volume 120 may be used to stow clean clothes, and a second complementary volume may be used to stow dirty clothes. In the depicted embodiment, hangers 170 are hung on a rod 175 inside the main cavity 115 near a top face 180 of the travel bag 110. The travel bag 110 has a U-shaped handle 140 telescoping from opposing parallel sides 145. Telescoping stems 150 of the U-shaped handle 140 frame the main cavity 115. These telescoping stems 150 slideably telescope into and out of the opposing parallel sides 145. Because the stems 150 of the U-shaped handle 140 are adjacent to the opposing parallel sides 145, the stems 150 to not obstruct access to the main cavity 115 by way of the full-face doors 130, 135. The travel bag 110 has wheels 155 at a bottom face of the cuboid. These wheels 155 may permit the travel bag 110 to be pulled behind the traveler 100 in a trailer fashion. A traveler 100 may advantageously access two complementary volumes 120, 125 of a main cavity 115 via full-face doors 120, 125.

In FIG. 1B, the traveler 100 has positioned the travel bag 115 on one of the full face doors 130 so as to orient a full-face opening 160 of the complementary volume 125 in a vertical facing direction. The traveler 115 is stowing dirty cloths 165 into the complementary volume 125. A dynamically adjustable divider 185 provides a floor for the complementary volume 125 when oriented as depicted. When oriented as depicted in FIG. 1A, the dynamically adjustable divider 185 provides a wall between the complementary volumes 120, 125. The U-shaped handle 140 is depicted in a recessed position in FIG. 1B. In the depicted recessed position, the stems 150 of the U-shaped handle 140 have been slideably inserted into the lateral sides 145 of the travel bag 110. A top cross-bar 190 of the U-shaped handle 140 may be adjacent to the top face 180 of the travel bag 110 when in the recessed position. In some embodiments, the top surface 180 may have a recessed topology for receiving the cross-bar 190 of the U-shaped handle 140. In some embodiments, when the U-shaped handle 140 is received into a recess in the top surface 180 of the travel bag 100, the top surface 180 and the cross-bar 190 will present a substantially flush exterior face.

Figure 2A:
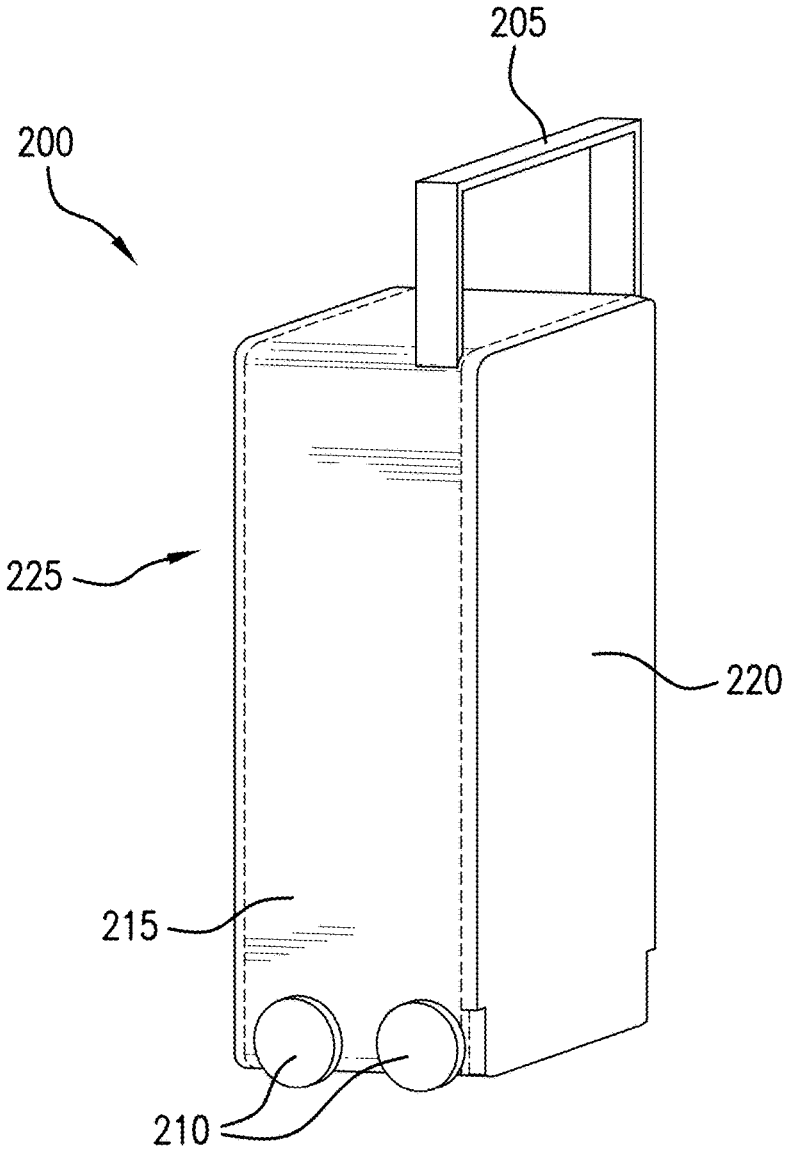
FIGS. 2A-2B depict a perspective view and a plan view of an exemplary wheeled suitcase having two full-faced doors.
Figure 2B:
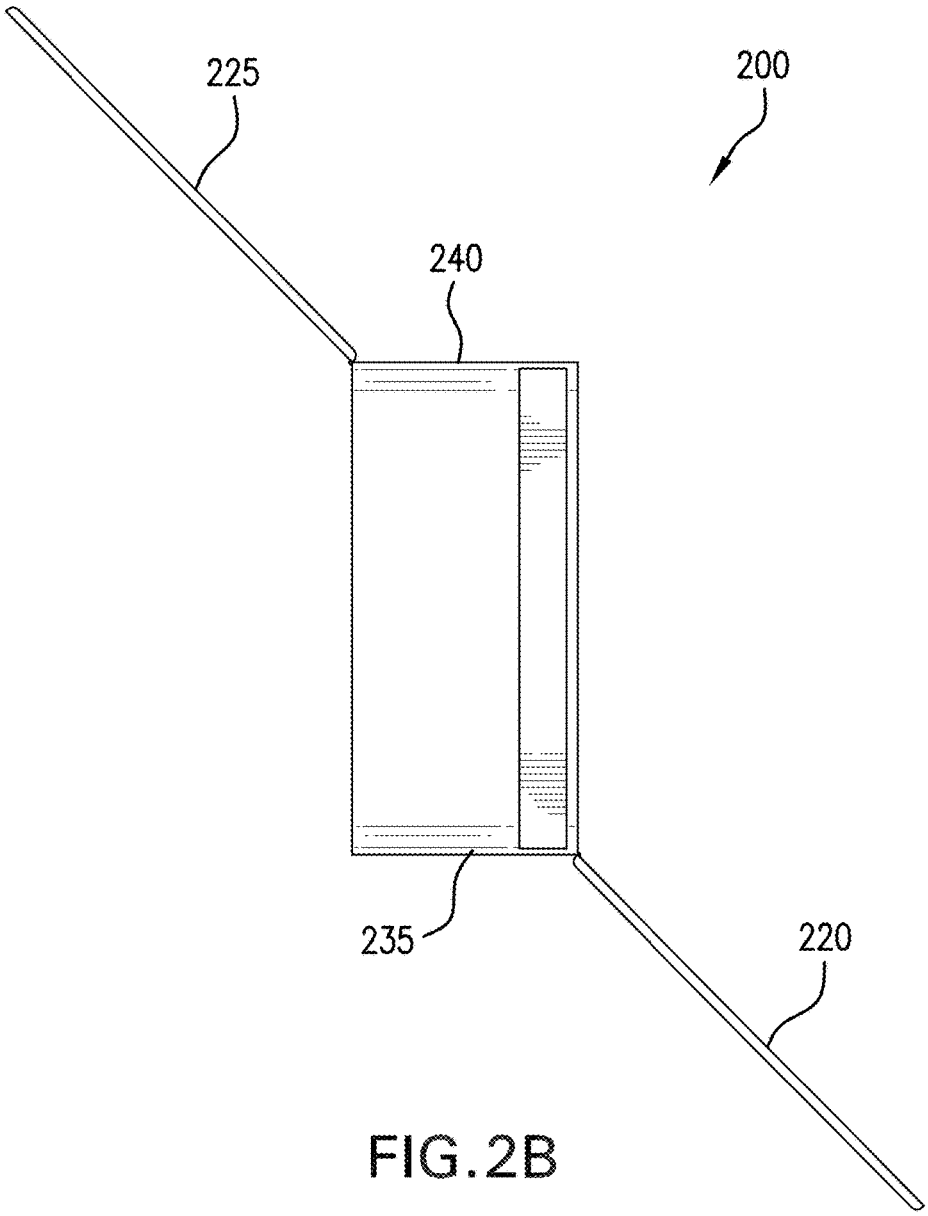

FIGS. 2A-2B depict a perspective view and a plan view of an exemplary wheeled suitcase having two full-faced doors. In the FIG. 2A embodiment, a dual full-face opening suitcase 200 includes a telescoping handle 205 and rolling wheels 210. The rolling wheels 210 may be inset into the lateral sides 215 of the suitcase 200. When inset into the lateral sides 215, the combined surface of the wheels 210 and the lateral sides 215 may present a substantially planar exterior face. In some embodiments, the wheels 210 may project out from the lateral sides 215. In an exemplary embodiment the wheels 210 may be inset so that the exterior of the wheels define a plane that is parallel but recessed to the plane of the lateral surface 215, for example. Two faces 220, 225 of the suitcase 200 may provide full-face access to a central cavity. In the FIG. 2A depiction, the opening faces 220, 225 are in a closed position. The telescoping handle 205 is depicted in an extended position. The telescoping handle has a cross beam 230 providing a holding surface throughout a lateral length of the suitcase 200.

In FIG. 2B, the exemplary dual full-face opening suitcase 200 shows both opening faces 220, 225 in an open position from a plan view perspective. In the depicted embodiment, the opening faces 220, 225 are hinged from opposite lateral faces 235, 240, respectively. In some embodiments, the opening faces 220, 225 may be hinged from the same lateral face. In some embodiments, the opening faces 220, 225 may be zippered openings. In some embodiments, the opening faces 220, 225 may be made of a rigid or semi-riding materiel, such as, for example, a hard polymer. In an exemplary embodiment, the opening faces 220, 225 may be made of a soft material. For example, in some embodiments, the opening faces 220, 225 may include canvas. In some embodiments, the faces may include polyester and/or nylon.

Figure 3A:
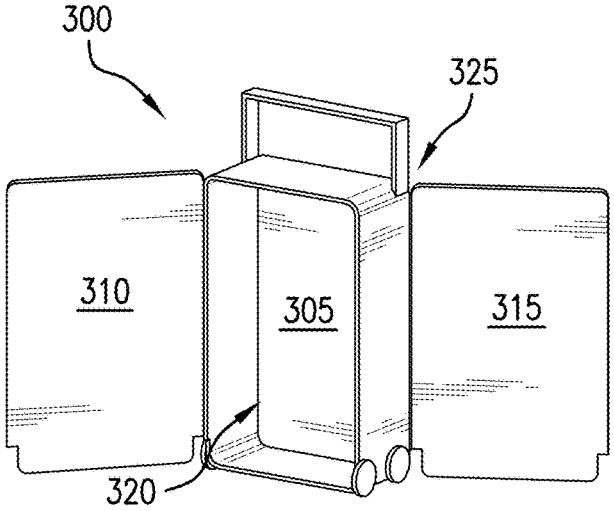
FIGS. 3A, 3B, and 3C depict perspective views of an exemplary dynamic interior partitioning membrane as seen through a front primary surface opening.
Figure 3B:
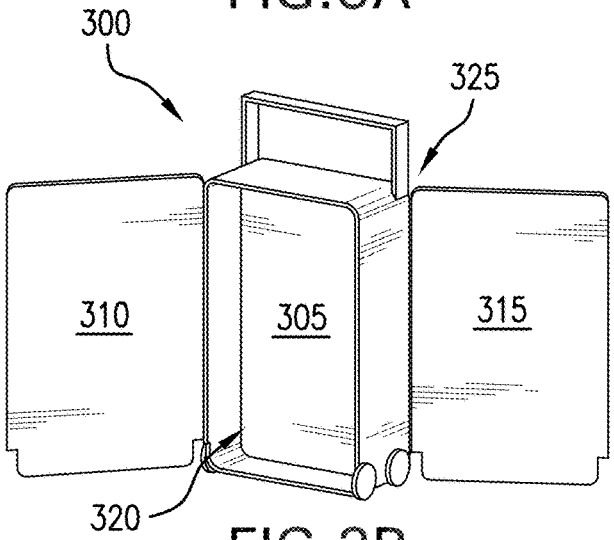
Figure 3C:
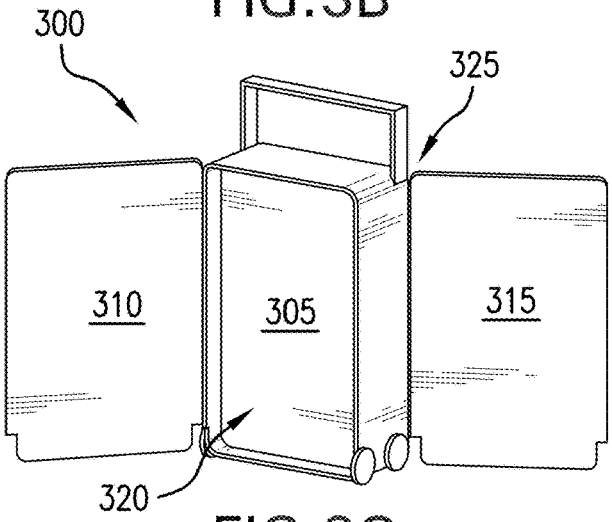

FIGS. 3A, 3B, and 3C depict perspective views of an exemplary dynamic interior partitioning membrane as seen through a front primary surface opening. In FIGS. 3A-3C, an exemplary suitcase 300 having a dynamic cavity separator 305 is shown. The exemplary suitcase 300 has a front full-face opening 310 and a rear full-face opening 315. The exemplary suitcase 300 has a front volume 320 accessible opening the front full-face opening 310 and a rear volume 325 accessible from the open rear full-face opening 315. In the FIG. 3A depiction, the cavity separator 305 is in a position that provides a large front volume 320. In the FIG. 3A depiction, the rear volume 325 may be smaller than front volume 320. In the FIG. 3B depiction, the cavity separator 305 is in a position in which the front volume 320 and the rear volume 325 may be substantially equal. In the FIG. 3C depiction, the cavity separator 305 is in a position in which the rear volume 325 may be greater than the front volume 320. A sum of the front volume 320 and the rear volume 325 may be constant and independent of the position of the cavity separator 305.

Figure 4A:
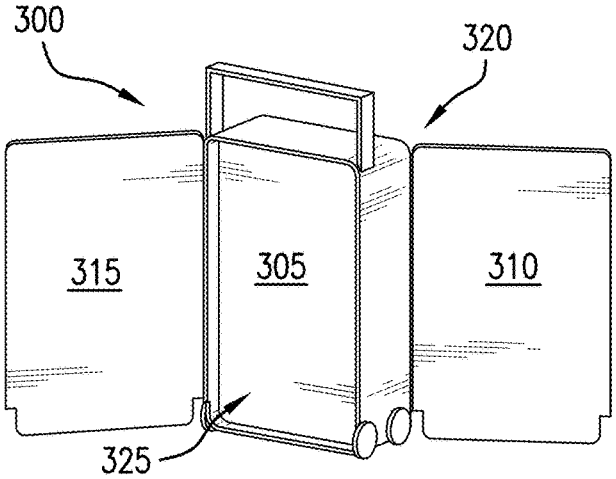
FIGS. 4A, 4B, and 4C depict perspective views of an exemplary dynamic interior partitioning membrane as seen through a back primary surface opening.
Figure 4B:
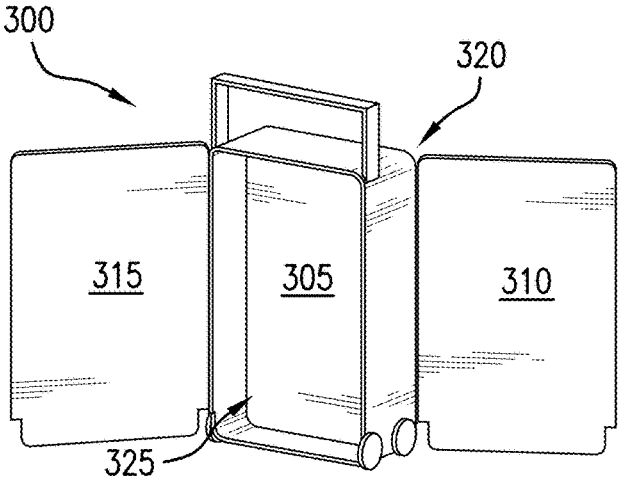
Figure 4C:
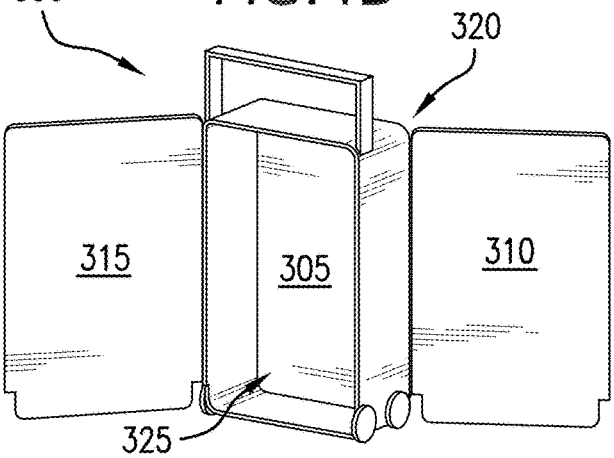

FIGS. 4A, 4B, and 4C depict perspective views of an exemplary dynamic interior partitioning membrane as seen through a back primary surface opening. FIG. 4A is a different perspective view of FIG. 3A. In FIG. 4A, the internal cavity separator 305 can be seen through the rear full-face opening 315. From this perspective, the rear volume 325 is small compared with the front volume 320 seen in FIG. 3A. FIG. 4B is a different perspective view of FIG. 3B. From the FIG. 4B perspective, the rear volume 325 is approximately equal to the complementary front volume 320 depicted in FIG. 3B. FIG. 4C is a different perspective view of FIG. 3C. From the FIG. 4C perspective, the rear volume 325 is large compared with the complementary front volume 320 depicted in FIG. 3C.

Figure 5:
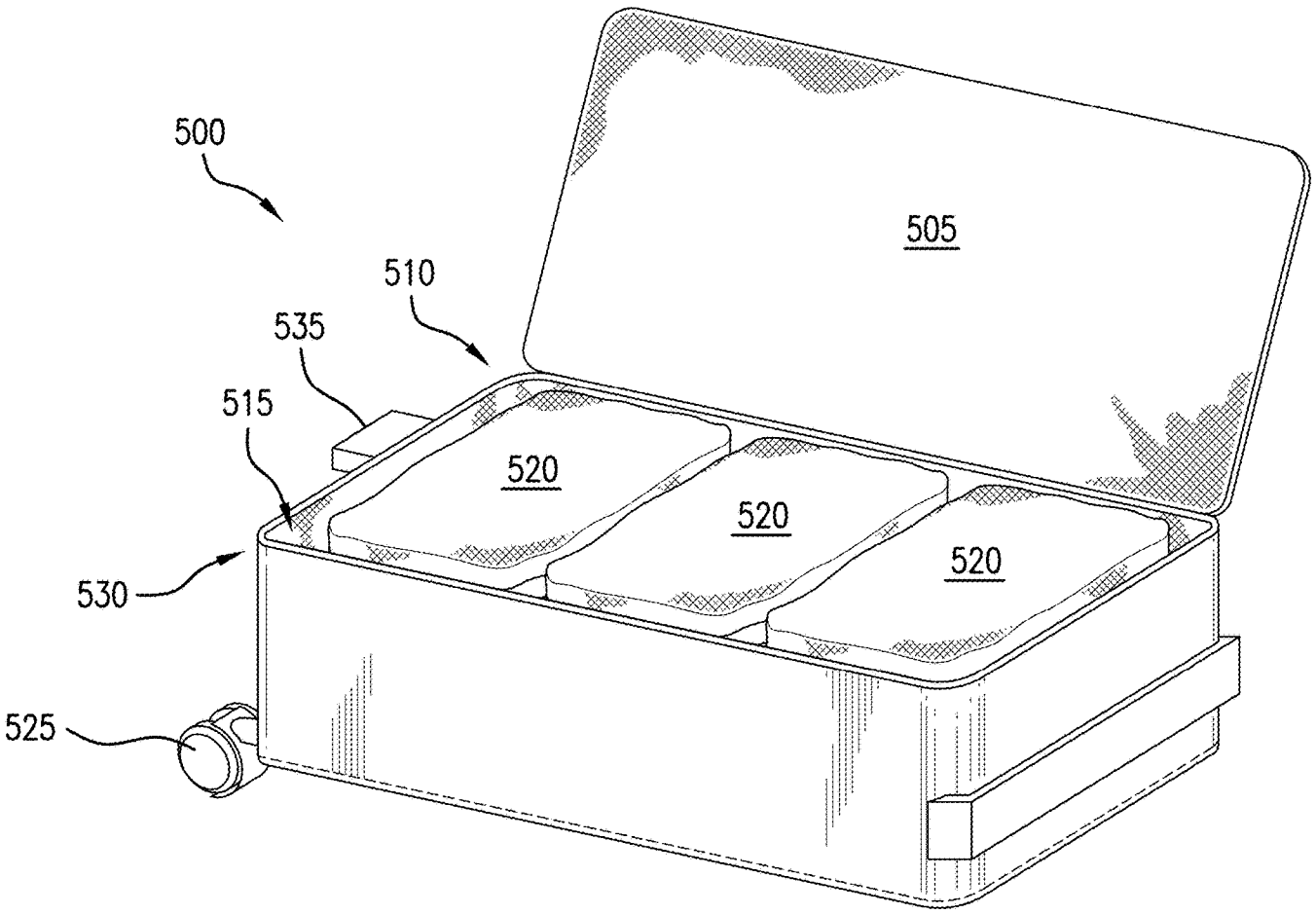
FIG. 5 depicts a perspective view of exemplary dual-face opening luggage laying on one face and opened on an opposite face.

FIG. 5 depicts a perspective view of exemplary dual-face opening luggage laying on one face and opened on an opposite face. In the FIG. 5 depiction, an exemplary dual-face opening luggage 500 is laying on one of the faces with another face 505 open. The open face 505 permits easy access to a storage volume 510. In the depicted position, a dynamic volume allocation member 515 may operate as a floor to the storage volume 510 accessible via the open face 505. Folded towels 520 have been stowed in the storage volume 510. In the depicted embodiment, the dynamic volume allocation member 515 may rest upon stowed articles accessible from an opening face opposite the depicted open face 505. The dual-face opening luggage 500 has castered wheels 525 coupled to a rolling face 530. A support member 535 projects a distance below the rolling face 530, the distance being substantially equal to a distance of a projection of the castered wheels 525 below the rolling face 530. The equal distance of the projection so the castered wheels 525 and the support member 535 may permit the dual-face opening luggage to stand with an orientation in which each face of the luggage is either perpendicular to or parallel with a ground surface.

In some embodiments, the dynamic volume allocation member 515 may gravitationally provide the maximum volume available when oriented in the position depicted in FIG. 5. In some embodiments, the dynamic volume allocation member 515 may be positioned by a user to a desired volume allocation. In some embodiments, the dynamic volume allocation member 515 may be rigid and/or semi-rigid. In some examples, the dynamic volume allocation member 515 may be flexible. In some embodiments, the dynamic volume allocation member 515 may provide support for stowed luggage contents. For example, in some embodiments, the dynamic volume allocation member 515 may support a weight of items place thereupon when oriented in the FIG. 5 orientation without transferring the weight to items in the other volume separated by the dynamic volume allocation member 515. In some embodiments, the dynamic volume allocation member 515 may be continuously adjustable between a first extreme position and a second extreme position. For example, a first extreme position may define a minimum volume for a volume accessible via a first face opening. A second extreme position may define a maximum volume for a volume accessible via a first face opening. The dynamic volume allocation member 515 may be continuously adjustable between the maximum and minimum volumes. Complementary volumes to these maximum and minimum volumes may be accessed via a second face opening. The sum of the volume accessible via the first face opening and the volume accessible via the second face opening may be independent of a position of the dynamic volume allocation member 515.

Figure 6:
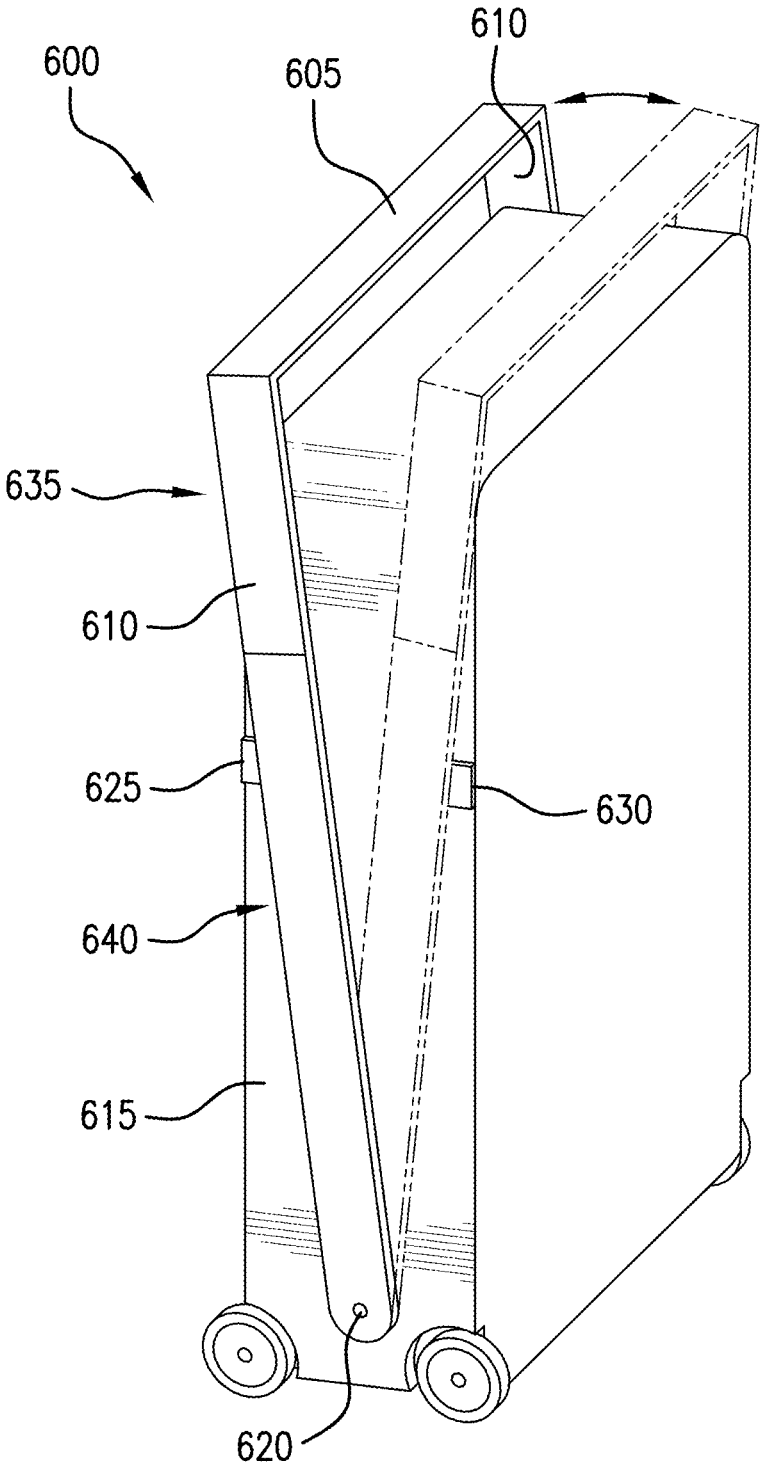
FIG. 6 depicts an exemplary U-shaped pivotable handle framing major opening surfaces.

FIG. 6 depicts an exemplary U-shaped pivotable handle framing major opening surfaces. In the FIG. 6 embodiment, an exemplary wheeled suitcase 600 includes a laterally connected U-shaped handle 605. The laterally connected U-shaped handle 605 has stems 610 pivotably connected to stowage container 615 at lateral pivot points 620. The U-shaped handle 605 may be releasably secured to the stowage container 615 in one or more positions. For example, the stems 610 of the U-shaped handle 605 may releasably couple to a pivot stop 625 as depicted. The stems 610 may be released from the pivot stop 625, the U-handle pivoted about the pivot points 620, and the stems 610 may be releasably coupled to the pivot stop 630, for example. In some embodiments, the stems 610 may include a telescoping portion 635 slidably connected to a fixed portion 640. In some embodiments, telescoping may be enabled when a user releases a locking mechanism. In some embodiments, the U-shaped handle may have multiple telescoping lengths. In an exemplary embodiment, each telescoping length may be lockably secured. In exemplary embodiments, each telescoping length may be secured by a detent, for example.

Figure 7:
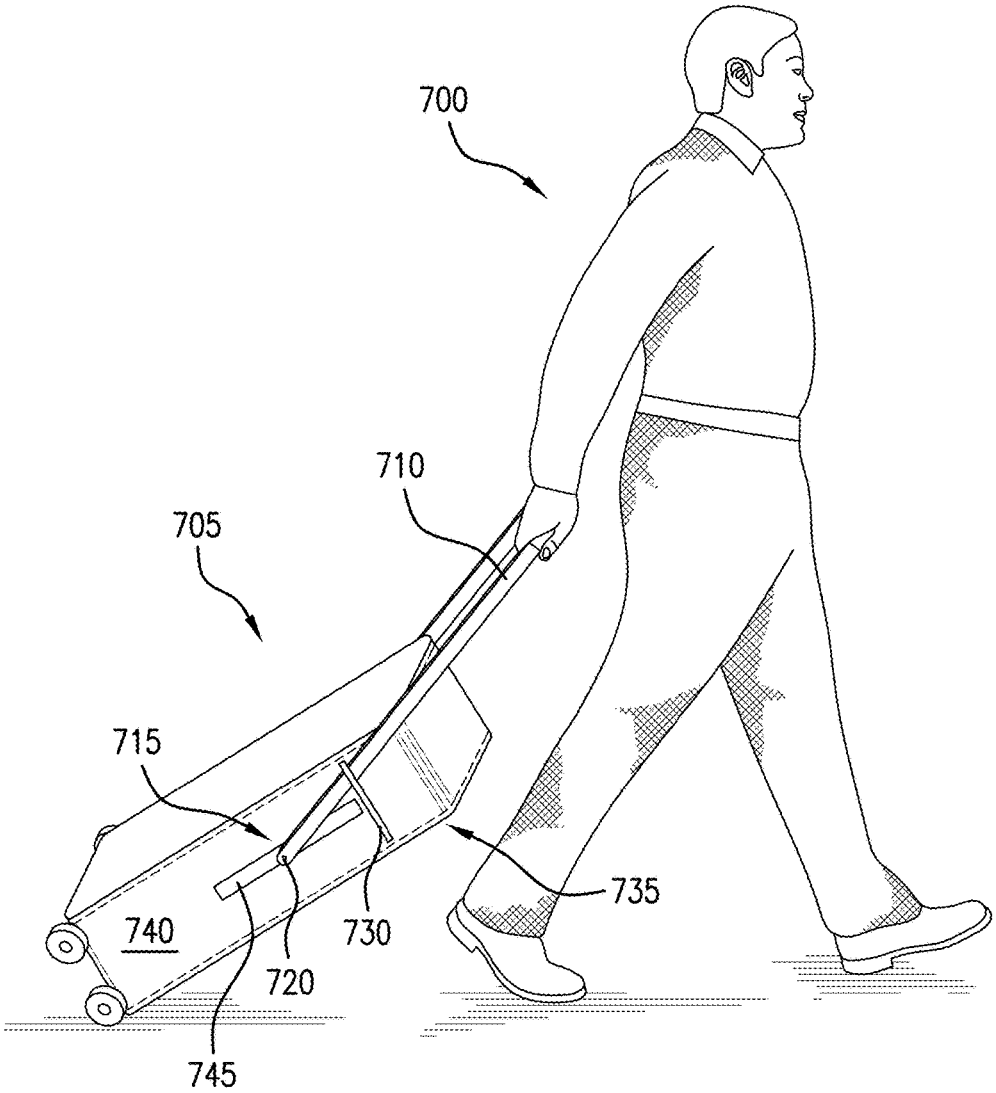
FIG. 7 depicts an exemplary roller bag being towed by a traveler.

FIG. 7 depicts an exemplary roller bag being towed by a traveler. In the FIG. 7 depiction, a traveler 700 is pulling a wheeled suitcase 705 via a U-shaped handle 710. The U-shaped handle 705 has a telescoping pivot connector 715. The telescoping pivot connector 715 may both slidably couple to the wheeled suitcase 705 and may pivot about a pivot point 720. A range of pivotable angles may be limited by a pivot limiting member 730 at a top end 735 of a lateral face 740 of the wheeled suitcase 705. The pivotable range may be small when the U-shaped handle 705 is extended minimally from a telescoping channel 740. But when the U-shaped handle 705 is fully extended from the telescoping channel 745, the pivotable range may be large. Such a telescoping pivot connector may provide an optimal angle of tilt for pulling the wheeled suitcase 705 for both tall and short travelers, for example.

Figure 8A:
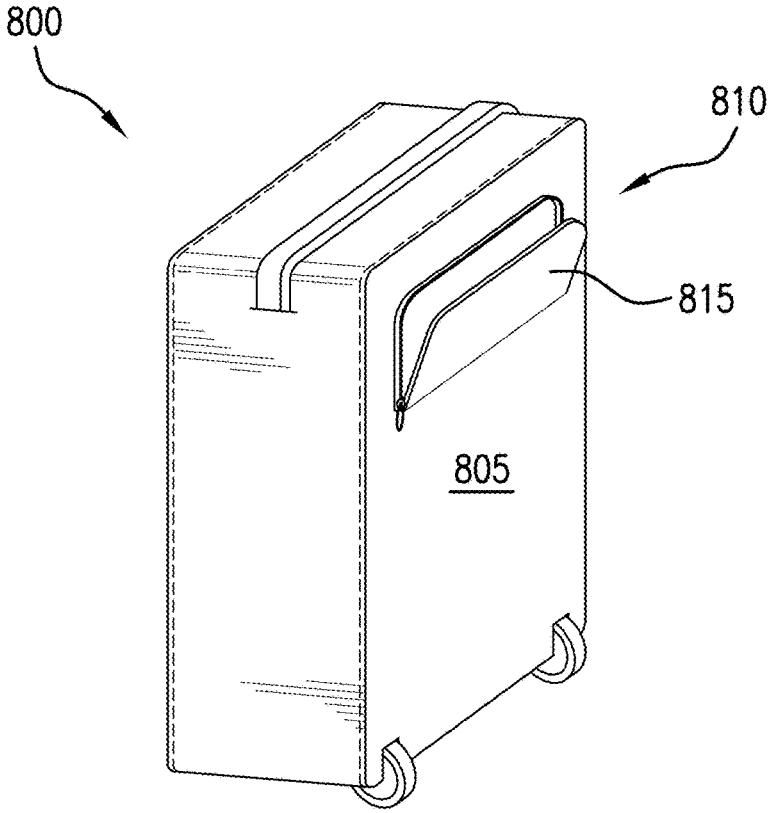
FIGS. 8A-8B depict an exemplary suitcase providing opposing side access to a central cavity separated by a dynamic membrane.
Figure 8B:
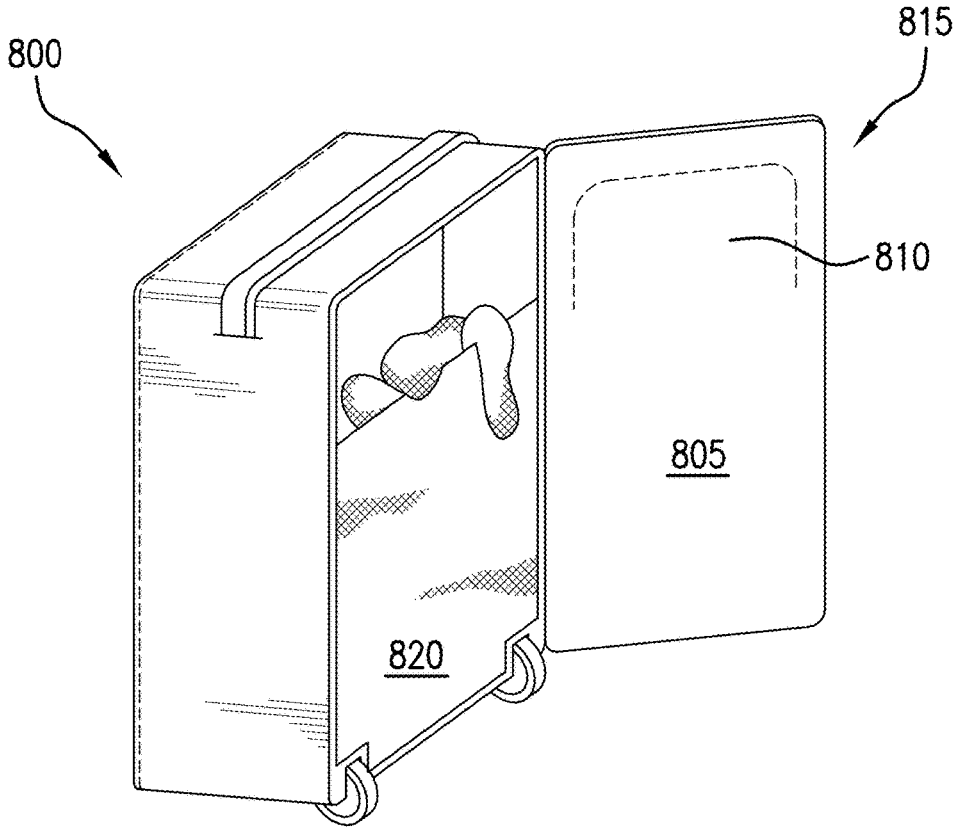

FIGS. 8A-8B depict an exemplary suitcase providing opposing side access to a central cavity separated by a dynamic membrane. In the FIGS. 8A-8B embodiment, an exemplary travel case 800 includes a full-face opening member 805. The full-face opening member 805 may have a secondary opening window 810. In the depicted embodiment, a secondary opening window may provide access to a stowage space within the travel case 800. The zippered window may be located at an upper end 815 of the full-face opening member 805. A user may, for example, designate the stowage space accessible via the secondary opening window as a dirty clothes hamper, for example. When the secondary opening window is opened, a user may place dirty clothes into the accessible stowage space. To later remove the dirty clothes, the user may open the full-face opening member 805, as depicted in FIG. 8B. In the FIG. 8B embodiment, a dirty clothes apron 820 may retain the clothes within the accessible space even with the full-face opening member 805 opened. In some embodiments, the dirty clothes apron 820 may be made of a textile material, for example. In some embodiments, the dirty clothes apron may be made of a flexible material. In an exemplary embodiment, the dirty clothes apron may be further opened via an opening mechanism, such as, for example, a zipper.

In some embodiments, a full-face opening member may be openable in a limited fashion and/or in a full-face fashion. For example, a full-face opening member may be openable from a top end only to permit access to a dirty clothes hamper accessible therethrough. If desired, however, a user may fully open the full-face opening member to gain full access to the clothes hamper, for example.

Figure 9A:
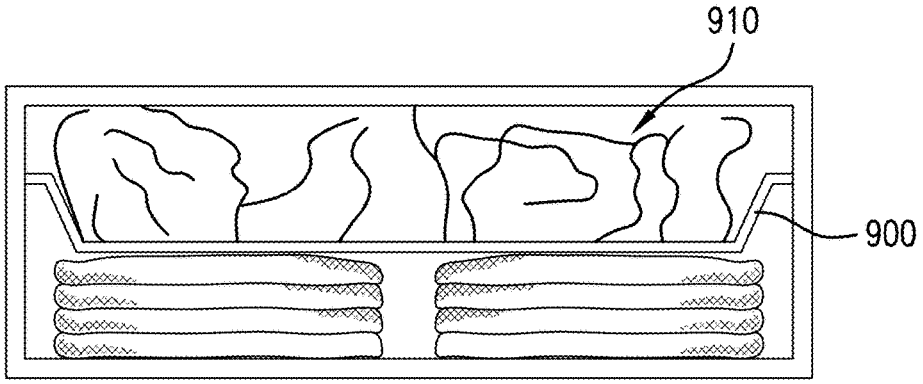
FIGS. 9A-9B depict cross-sectional views of exemplary dynamic partitioning membranes for a central suitcase cavity.
Figure 9B:
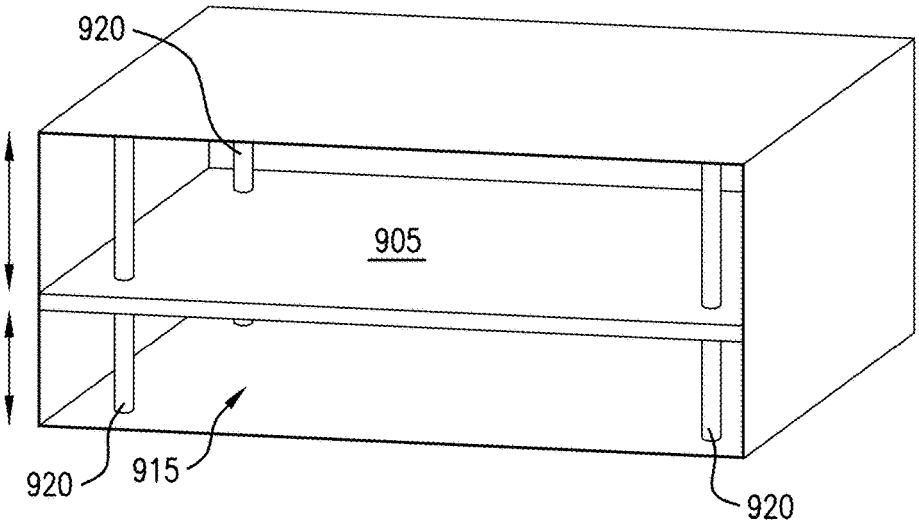

FIGS. 9A-9B depict cross-sectional views of exemplary dynamic partitioning membranes for a central suitcase cavity. In FIGS. 9A-9B exemplary dynamic volume allocation members 900, 905 are depicted. In the FIG. 9A embodiment, a flexible dynamic volume allocation member 900 spans an internal cavity of an exemplary luggage compartment 910. The flexible dynamic volume allocation member 900 may allocate the volume of the internal cavity between two subspaces, each externally accessible by openings on opposite faces of the luggage compartment. In some embodiments, the dynamic volume allocation member 900 may be removable from the luggage compartment. For example, if a user wants a single volume accessible by both opposite faced openings, the user may remove the dynamic volume allocation member 900. If, however, the user desires to have two complementary volumes, each accessible via a different opening, the user may install the dynamic volume allocation member 900. In the FIG. 9B embodiment, a rigid dynamic volume allocation member 905 slidably traverses an internal cavity of an exemplary luggage compartment 915. In the depicted embodiment, the exemplary luggage compartment 915 has guide rods 920 that direct the travel of the rigid dynamic volume allocation member 905. Various ways of providing dynamic volume allocation may be used. For example, in some embodiments a motorized screw mechanism may set the dynamic allocation of the internal cavity volume.

Although various embodiments have been described with reference to the Figures, other embodiments are possible. For example, some embodiments may have two wheels. In an exemplary embodiment a wheeled suitcase may have four wheels. Some wheels may automatically retract when the U-shaped handle is fully retracted within a telescoping track, for example. In some embodiments, the wheels may be automatically presented external to a suitcase face when the U-shaped handle is extracted from a telescoping channel.

Figure 10:
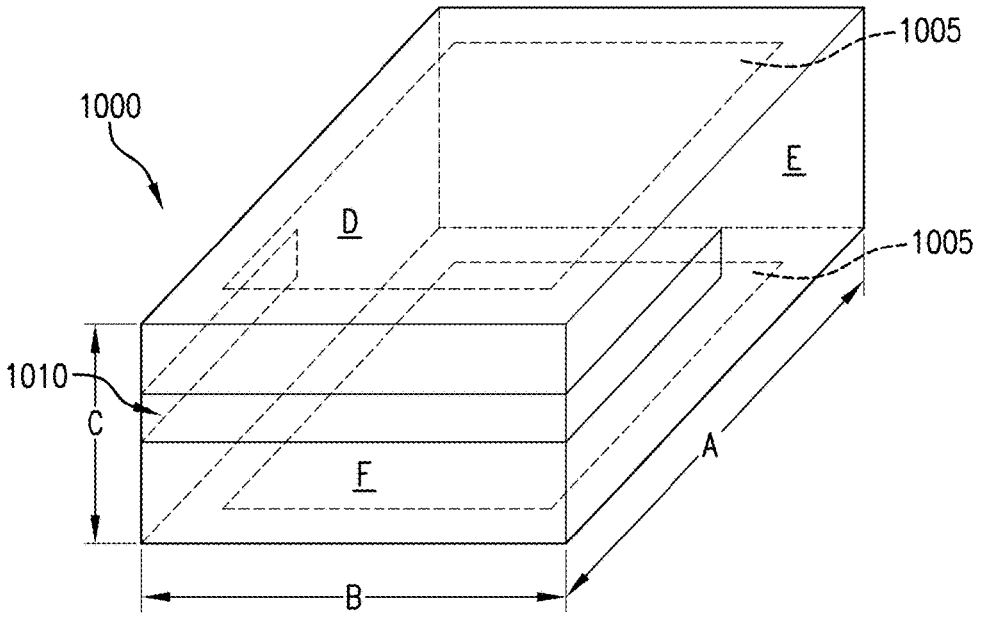
FIG. 10 depicts an exemplary cuboid shaped cavity.
Figure 11A:
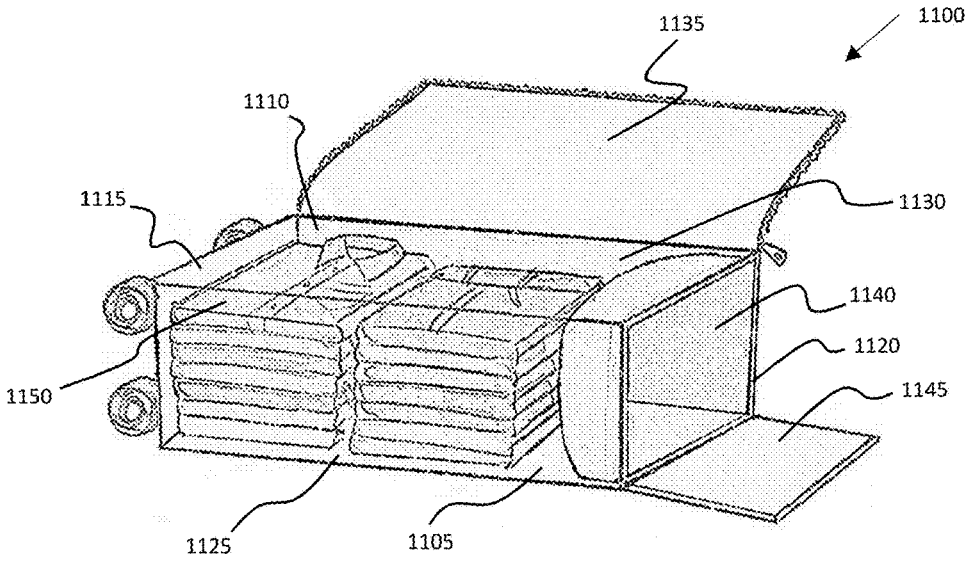
FIG. 11A depicts a side perspective view of a luggage lying on a backside and having an exemplary dynamic volume receptacle.
Figure 11B:
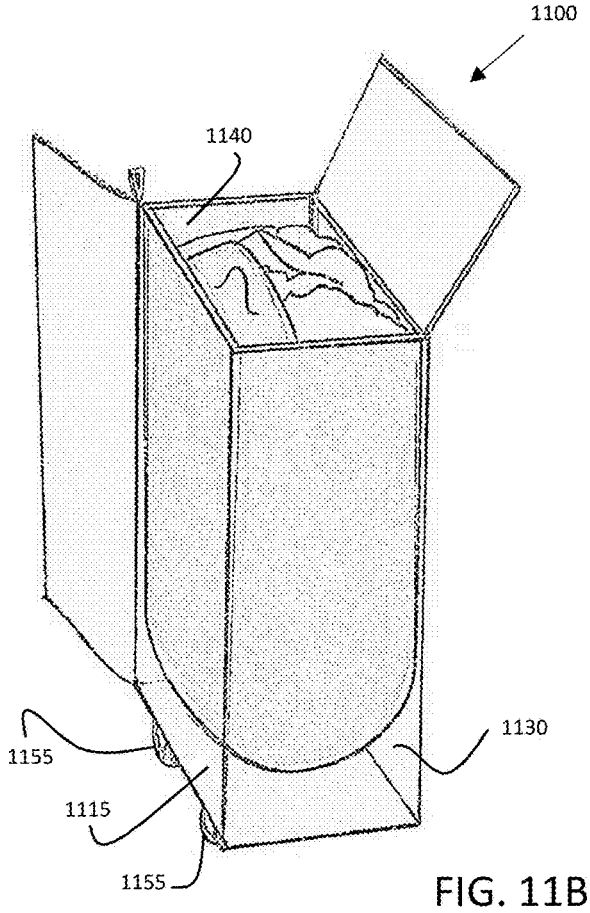
FIG. 11B depicts a side perspective view of an exemplary dynamic volume receptacle expended within a standing piece of luggage.

FIG. 10 depicts an exemplary cuboid shaped cavity. In an exemplary embodiment, a stowage container may have a cavity 1000 that is substantially cuboid shaped. In some embodiments, the cuboid may have a first dimension, A, greater than a second dimension, B. In some embodiments, the second dimension, B, is greater than a third dimension, C. In various embodiments, the cuboid will have substantially parallel primary faces, D, each having dimensions A and B. Some embodiments will have secondary faces, E, each having dimensions A and C. Some embodiments will have tertiary faces, F, each having dimensions B and C. In an exemplary embodiment, the primary faces, D, may have opening windows that permit a majority of each face to be opened to permit access to a volume within. In some embodiments a ratio of an area of the opening window to an area of the primary face is greater than 70%. In some embodiments, the ratio of the area of the opening window to the area of the primary face is greater than 75%. In an exemplary embodiment, the ratio of the area of the opening window to the area of the primary face is greater than 82.5%. In some embodiments, the ratio of the area of the opening window to the area of the primary face is greater than 90%. In some embodiments, the ratio of the area of the opening window to the area of the primary face is greater than 95%. In some embodiments, a top tertiary face may be adjacent to a U-shaped handle. In some embodiments, the top tertiary face may be non-planar. In some embodiments, the top tertiary face may have an arcuate surface.

In an exemplary embodiment, the primary faces, D, each are depicted having a substantially full-faced opening window 1005. These opening windows 1005 may define a path in the shape of a mathematical prism. The opening windows 1005 may define the polygon bases of the prism. In the depicted embodiment, the bases are rectangles. When the vertices of the opening windows 1005 are connected to corresponding vertices of each other, a rectangular prism is defined. The path defined by the rectangular prism may project through a U-shaped handle 1010 depicted in the figure. The prism-shaped path may define an access path to the internal cavity of the luggage. The prism-shaped access path may be unimpeded by the U-shaped handle.

FIG. 11A depicts a side perspective view of a luggage lying on a backside and having an exemplary dynamic volume receptacle. A luggage 1100 includes a pair of side panels 1105, 1110 extending between a bottom panel 1115 towards a top end 1120, and being substantially parallel to a longitudinal axis. A back panel 1125 extends between the side panels 1105, 1110 to form a primary chamber 1130. A front door 1135 hingedly attaches to the side panel 1110 such that the front door 1135 may engage the periphery of the primary chamber 1130 when in a closed position. As depicted, the front door 1135 is in an open position. A dynamic volume receptacle (DVR) 1140 releasably couples to the luggage 1110 at the top end 1120. An auxiliary door 1145 hingedly attaches to the back panel 1125. As depicted, the auxiliary door 1145 is in an open position. In a closed position, the auxiliary door 1145 may engage a periphery of the top end 1120 to enclose the DVR 1140.

In the illustrative example, a user's folded clothes 1150 occupy the primary chamber 1130 while the DVR 1140 is in a retracted state maximize the available volume within the primary chamber 1130. In various embodiments, when in an open state, a user may access the DVR 1140 while the front door 1135 is in a closed state, for example. The user may access the primary chamber 1130 through the front door 1135 (e.g., in open position) while the top door is in a closed position.

FIG. 11B depicts a side perspective view of an exemplary DVR expended within a standing piece of luggage. The luggage 1100 includes multiple wheels 1155 attached to the bottom panel 1115 and extending in a direction opposite the top end 1120. The luggage 1100 is in an upright position supported by wheels 1155. The DVR1140 is expanded to fill the primary chamber 1130. As depicted, the clothes 1150 fill the expended DVR 1140. The clothes 1150 may be in an unfolded state. In an illustrative example, a user may remove the folded clothes (with reference to FIG. 11A) such that the available volume of the primary chamber 1130 increases to permit the DVR1140 to expand into the primary chamber 1130. A user may deposit clothes 1150 into the DVR1140 after the users uses (e.g., the clothes gets dirty) the clothes 1150. The DVR 1140 may prevent communication between the primary chamber 1130 and the contents (e.g., the clothes 1150) of the DVR1140.

A predetermined nominal capacity of the DVR 1140 may be inversely proportional to a volume of the primary chamber 1130. For example, when a capacity of the DVR 1140 is at 5 percent, the available volume of the primary chamber 1130 is at 95 percent. In another example, when the capacity of the DVR 1140 is at 70 percent, the available volume of the primary chamber 1130 is at thirty percent.

In some embodiments, the DVR 1140 may include compartments to separate contents stored in the dynamic volume receptacle. For example, a separator formed from a flexible material, such as a synthetic polymer, may divide the DVR 1140 to form compartments. A user may store wet items in one compartment while using another compartment to store dry items, for example.

Figure 12:
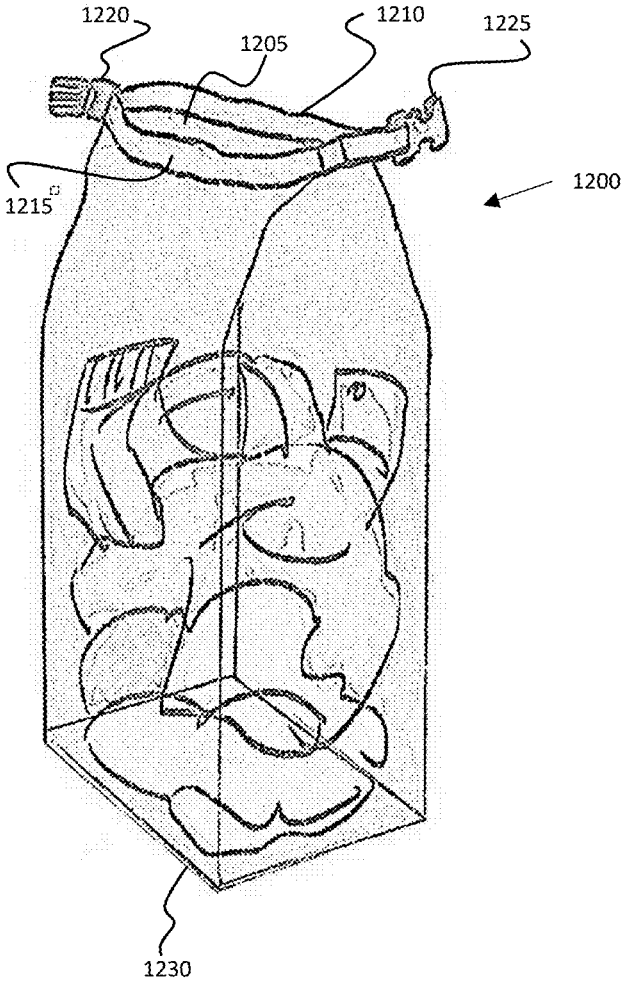
FIG. 12 depicts a side perspective view of an exemplary dynamic volume receptacle.

FIG. 12 depicts a side perspective view of an exemplary dynamic volume receptacle. A DVR 1200 includes an opening 1205. The opening 1205 may be closed via a pair of fasteners 1210, 1215 attached to the periphery of the opening 1205. A pair of couplings 1220, 1225 extend from the fasteners 1210, 1215 beyond the periphery of the opening 1205. As depicted, clothes (e.g., the clothes 1150) fills the DVR 1200.

In an illustrative example, the fastener 1210, 1215 register with each other to seal the opening 1205. The fasteners 1210, 1215 and couplings 1220, 1225 may define a capacity adjuster, for example. The fastener 1210 may have an interlocking groove that engages a groove of the fastener 1215 to form a seal when pressed together, for example. Once sealed, a user may fold the DVR 1200 along the sealed fasteners 1210, 1215. A user may roll the fold such that the predetermined capacity of the DVR 1200 decreases with each fold. Once the user adjusts the DVR1200 by folding the engaged fasteners 1210 to achieve a desired volume, the user may releasably couple the couplings 1220, 1225 to secure the folding such that the desired volume is maintained. In some embodiments, the DVR 1200 may include a cap at an end 1230 to enclose contents within the DVR 1200 when the user seals the fasteners 1210, 1215. The couplings 1220, 1225 may form a handle when coupled to facilitate transport of the DVR 1200 by a user.

In various embodiments, the DVR 1200 may be formed of a PVC-coated material to protect a primary chamber of a suitcase from moisture, for example.

Figure 13:
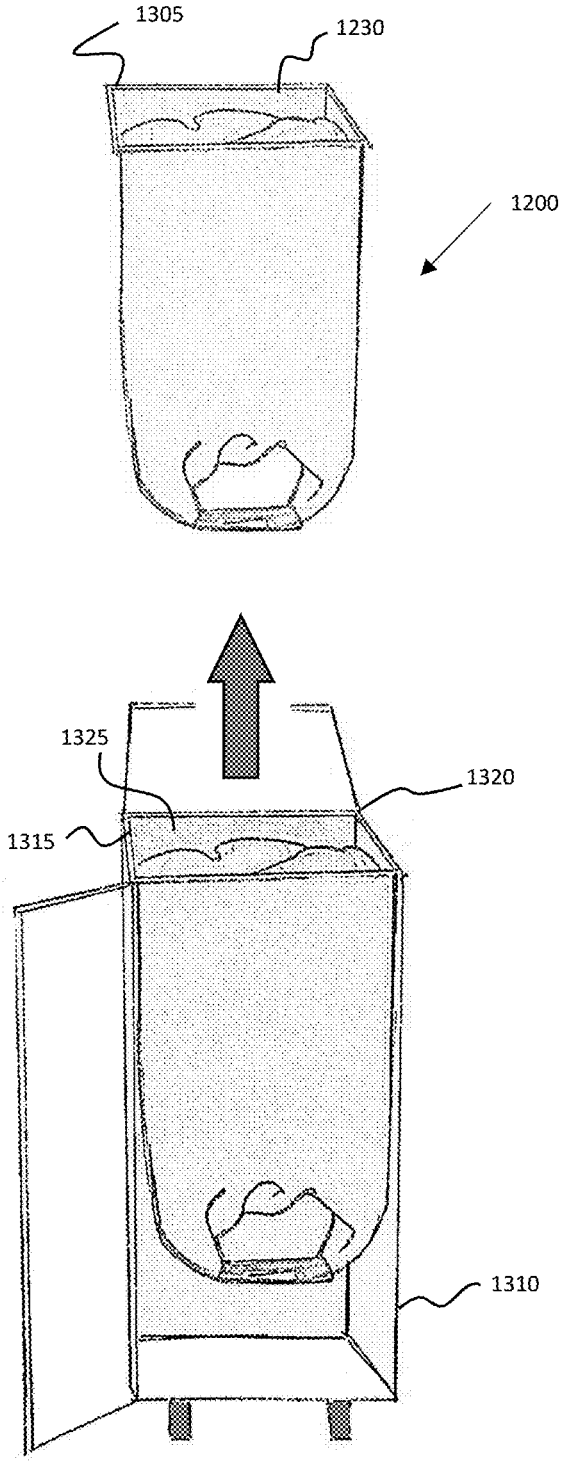
FIG. 13 depicts a mounting sequence for an exemplary dynamic volume receptacle into a luggage.

FIG. 13 depicts a mounting sequence for an exemplary dynamic volume receptacle into a luggage. With reference to FIG. 12, the DVR 1200 includes a coupling frame 1305 at the end 1230. As depicted, the opening 1205 is sealed by engaging the fasteners 1210, 1215, folding the DVR1200 along the sealed fasteners 1210, 1215, and coupling the couplings 1220, 1225. A suitcase 1310 includes a receiving frame 1315 at top end 1320. The receiving frame 1315 attaches to the suitcase 1310 to form a receptacle aperture 1325.

The coupling frame 1305 engages the receiving frame 1315 to mount the DVR1200 within the suitcase 1310. The receiving frame 1315 may be a recessed ledge guide. The coupling frame 1305 may include an engagement ridge that snaps into the recessed ledge guide to secure the DVR 1200 within the suitcase, for example.

Figure 14:
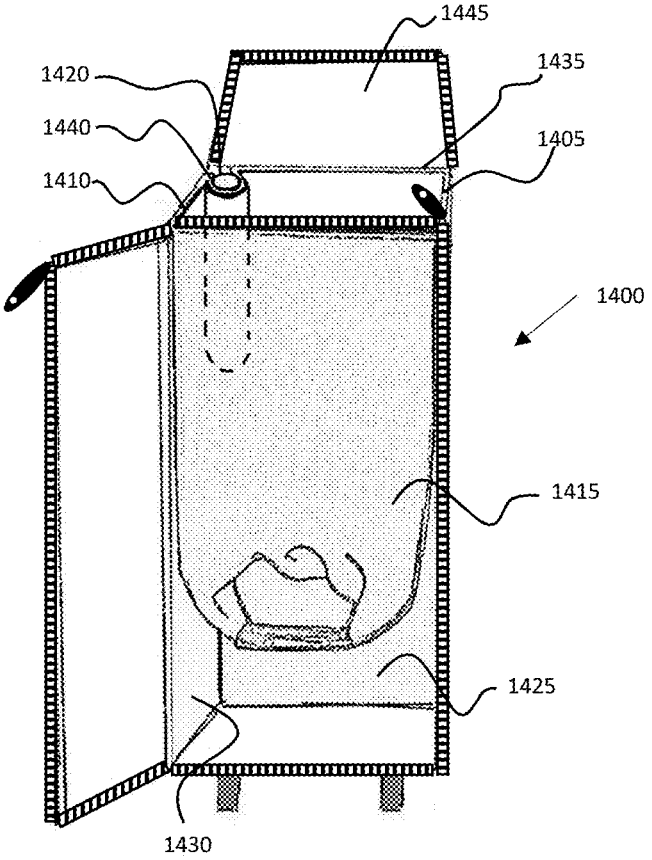
FIG. 14 depicts a front perspective view of a luggage with a built-in cylindrical container having an exemplary dynamic volume receptacle.

FIG. 14 depicts a front perspective view of a luggage with a built-in cylindrical container having an exemplary dynamic volume receptacle. A suitcase 1400 stands upright. The suitcase 1400 includes a receiving frame 1405. The receiving frame 1405 releasably couples to a coupling frame 1410 to secure a DVR 1415 within the suitcase 1400. In some embodiments, a zipper may couple the receiving frame 1405 to the coupling frame 1410. A tubular container 1420 attaches to the suitcase 1400 at a junction of a back panel 1425 and a side panel 1430. The tubular container 1420 includes a tubular opening at a top end 1435. In some embodiments, the tubular container 1420 may be rigidly formed to provide a protecting surface for contents which may be stored within the tubular container 1420. A user may store an umbrella in the tubular container 1420, for example.

The receiving frame 1405 may include a cutout 1440 to accommodate the tubular container 1420. A top door 1445 hingedly attaches to the back panel 1425 at the top end 1435. As depicted, the top door 1445 is in an open position. While in the open position, a user may access an opening of the tubular container 1420 to store an umbrella, for example. The stored contents of the tubular container 1420 may be secured within the tubular container 1420 when the top door 1445 is in a closed position, for example.

As depicted, the tubular container 1420 is outside the DVR 1415. Placing the tubular container 1420 outside the DVR 1415 may permit the DVR 1415 to be collapsed, for example. In some embodiments, a collapsible material, such as a collapsible polymer, may form the tubular container 1420. A tubular container formed from a collapsible material may be placed inside the dynamic volume receptacle, for example.

Figure 15:
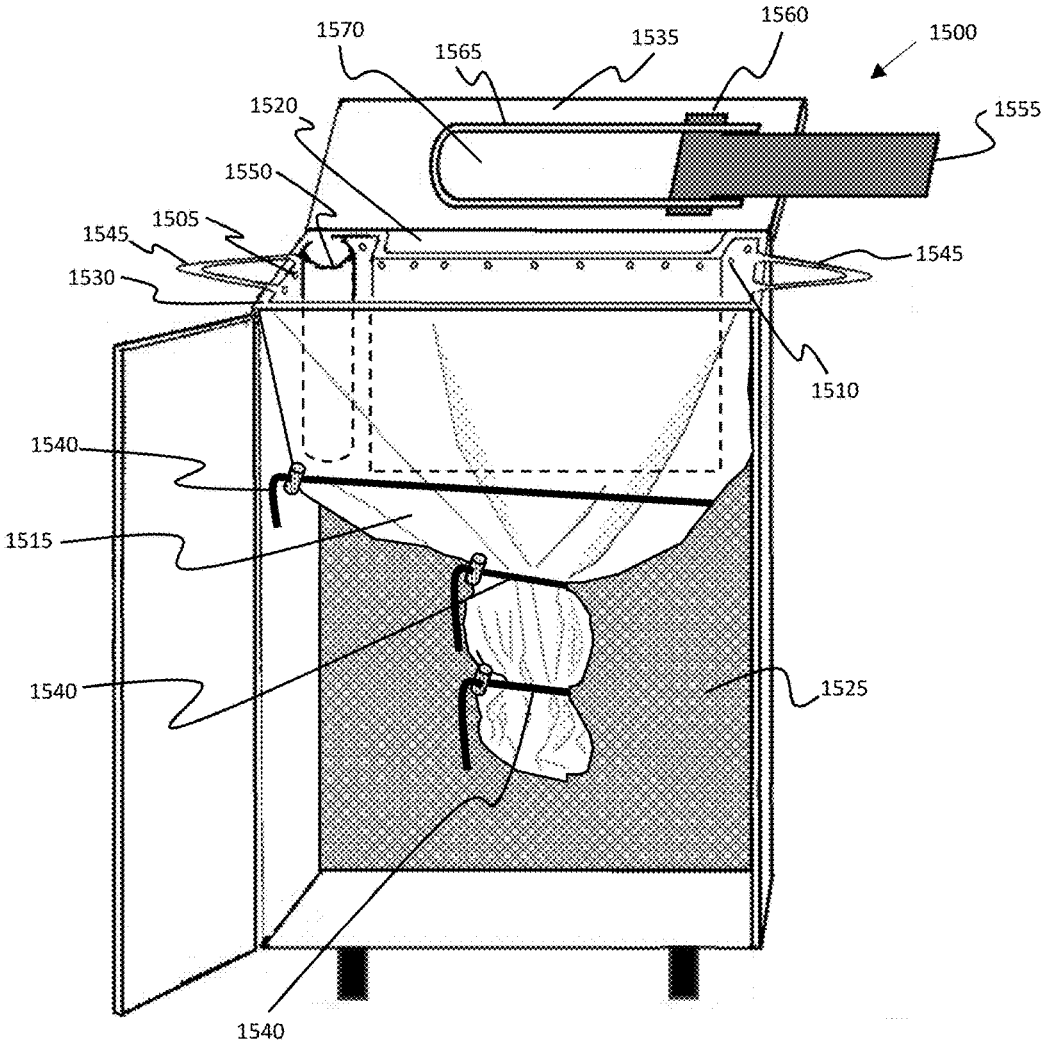
FIG. 15 depicts a front perspective view of a luggage with a built-in container having an exemplary dynamic volume receptacle.

FIG. 15 depicts a front perspective view of a luggage with a built-in container having an exemplary dynamic volume receptacle. A suitcase 1500 includes a multitude of receiving button snaps 1505. Each receiving button snap 1505 releasably couples to a push button 1510 to secure a DVR 1515 within the suitcase 1500. A rectangular container 1520 attaches to the suitcase 1500 along a back panel 1525 and opposite a closed front door, such as the front door 1135 in the closed position, for example. The rectangular container 1520 includes a receiving aperture at a top end 1530. In some embodiments, the rectangular container 1520 may be rigidly formed to provide a protecting surface for contents which may be stored within the rectangular container 1520. In the depicted embodiment, the rectangular container 1520 has an elongated profile to permit a user to store a laptop in the rectangular container 1520, for example. An outward surface of the rectangular container 1520 also includes receiving button snaps 1505.

A top door 1535 hingedly attaches to the back panel 1525 at the top end 1530. As depicted, the top door 1535 is in an open position. While in the open position, a user may access the receiving aperture of the rectangular container 1520 to store an electronic tablet, for example. The stored contents of the rectangular container 1520 may be secured within the rectangular container 1520 when the top door 1535 is in a closed position, for example. The top door 1545 may include a positive magnetic lining that engages with a negative magnetic lining that is disposed along the periphery at the top end 1530 to seal both the DVR 1515 and the rectangular container 1520.

The DVR 1515 includes a capacity adjuster having a multitude of drawstrings 1540. The drawstrings 1540 may tighten around the DVR 1515 to reduce the volume of the receptacle 1515, for example. Conversely, a user may loosen the drawstrings 1540 to permit the DVR 1515 to expand to increase in volume. In some embodiments, a user may tighten and loosen the drawstrings 1540 to divide contents within the DVR 1515, for example.

A pair of DVR handles 1545 fixedly attach to the DVR 1515. In an illustrative example, a user may disengage the DVR 1515 from the suitcase 1500 by pulling on the handles 1545. Once the user removes the DVR 1515 from the suitcase 1500, the user may transport the articles stored in the DVR 1515 by use of the handles 1545, for example. In the depicted example, the DVR 1515 includes a tubular container 1550 within a primary chamber of the DVR 1515.

A support tray 1555 extends from the top door 1535 substantially orthogonal to an adjacent side panel (e.g., the side panel 1105). The support tray 1555 include a wide section 1560. The wide section 1560 slidably attaches at opposing ends to a pair of support sliding rails 1565. In the depicted example, the support sliding rails 1565 are the extended members of a U-shaped bracket. The support sliding rails 1565 may permit the wide section 1560 to slide the support tray 1555 into the top door 1535. When the support tray 1555 is retracted into the top door 1535, a zipper may be engaged to secure the support tray 1555 within the top door 1535, for example. When the top door 1535 is fastened to the suitcase 1500 and the support tray 1555 is fully extended, a base 1570 of the U-shaped bracket may provide support to the support tray 1555 in the event that a laptop is placed on the support tray 1555, for example. The adjacent side panel may be formed of a substantially rigid material. The substantially rigid material may support a weight of the support tray 1555 and a device placed on the support tray 1555, for example.

In some embodiments, an intermediary door (not shown) may cover the DVR 1515 to provide a substantially planar surface when the top door 1535 is opened. A user may use the substantially planar surface to support a laptop while the user waits in an airport terminal, for example. The intermediary door may fit within a recessed ledge guide to minimize intrusion with the top door 1535. In some embodiments, the intermediary door may couple to the DVR 1515. When a user removes the DVR 1515 from the suitcase, the contents within the DVR 1515 may remain secure to permit a user to transport the DVR 1515, for example.

Figure 16:
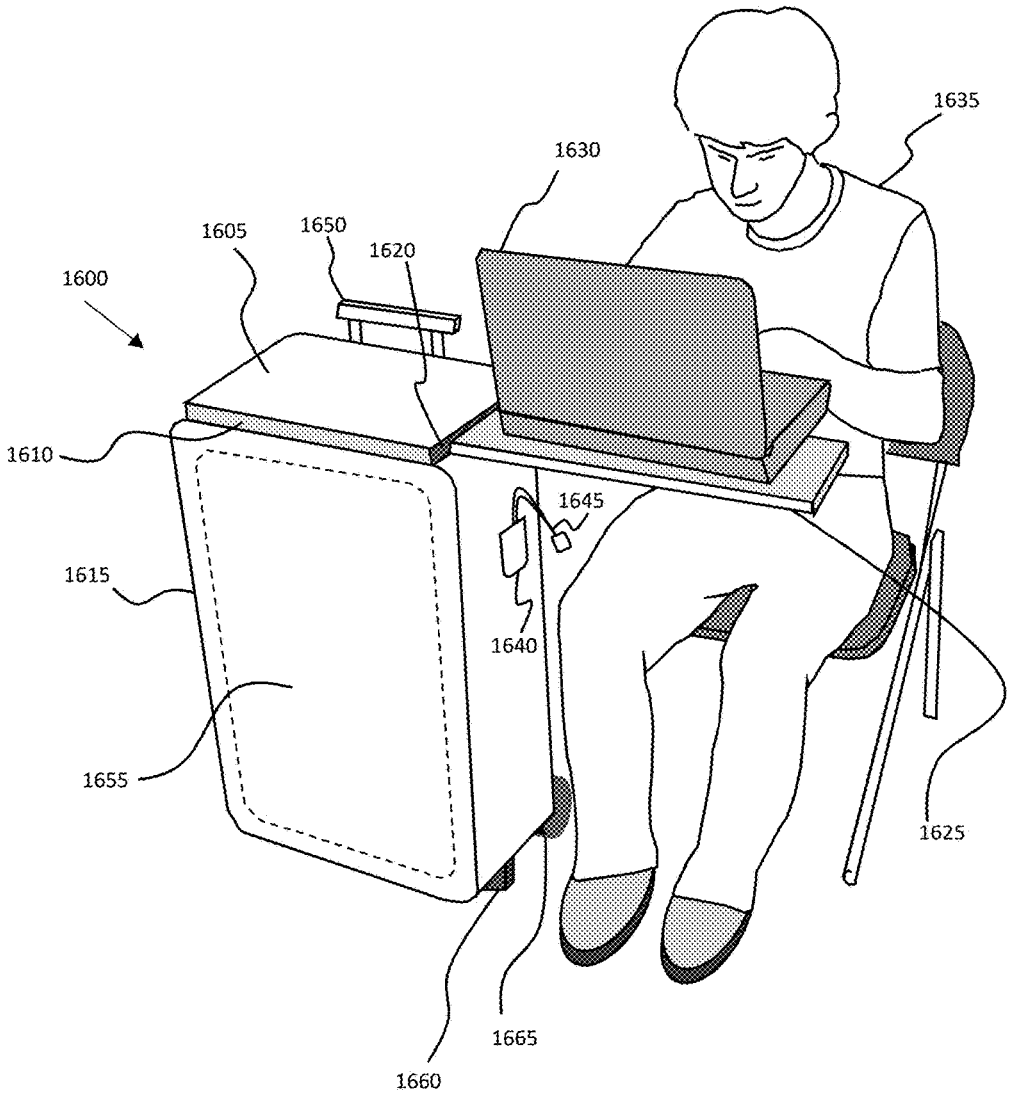
FIG. 16 depicts a perspective view of an exemplary luggage having a retractable support tray and an accessible battery pack.

FIG. 16 depicts a perspective view of an exemplary luggage having a retractable support tray and an accessible battery pack. A suitcase 1600 having a DVR (not shown) includes an auxiliary panel 1605. The auxiliary panel 1605 releasably attaches via a fastener 1610 (e.g., flexible material with interlocking members) to body 1615 of the suitcase 1600. The auxiliary panel 1605 includes a tray opening 1620 along a peripheral side of the auxiliary panel 1605. In the depicted embodiment, a sliding tray 1625 extends from the auxiliary panel 1605 through the opening 1620. The sliding tray 1625 supports an electronic device 1630, such as a laptop, for example. In various embodiments, a user 1635 may use the sliding tray 1625 to support a book or a tray of food, for example.

A power source pocket 1640 attaches to a periphery of the body 1615. The power source pocket 1640 may store a power bank (e.g., a battery pack). A charging cord 1645 may attach to the power bank. The charging cord 1645 extends from the power source pocket 1640 to provide access to the user 1635 to the power bank. In some embodiments, the power source pocket 1640 may attach within a primary chamber of the body 1615. A charging cord opening (not shown) may permit the user 1635 to charge an electronic device without direct access to the power bank when the primary chamber is closed, for example. In the depicted embodiment, the luggage 1600 includes a U-shaped telescoping arm 1650 attached to a back panel (not shown) of the body. The luggage further includes a pair of support legs 1660 and a pair of wheels 1665 (only one of the pair of wheels depicted). The user 1635 may extend the U-shaped telescoping arm 1650 and tilt the suitcase 1600 on the wheels 1665 to facilitate transporting the luggage 1600, for example.

In an illustrative example, while traveling the user may initially adjust a predetermined capacity of a DVR such that only a pair of shoes may be stored. Advantageously, the DVR may substantially isolate dirty contents, such as shoes, from clean contents (e.g., clean clothes) located in a primary chamber of the luggage, for example. As the user continues to travel, contents in the primary chamber may become soiled or damp. The user may desire to maintain clean clothes separate from soiled or damp articles, for example. The user may remove the DVR and operate the capacity adjuster to increase the predetermined volume capacity to store the dirty clothes. As such, the DVR may separate the clean clothes from a dynamic or increasing volume of soiled or damp articles, such as dirty clothes, for example. When the user desires to wash the dirty clothes, for example, the user may remove the DVR via handles from the primary chamber, leaving the contents of the primary chamber undisturbed. Advantageously, the user may store the clean clothes and wash only the dirty clothes to reduce consumption of soap and resources, such as water, for example.

In some embodiments, the primary face may have a height dimension less than a width dimension. In some embodiments two or more of the three cuboid dimensions may be equal to one another. For example, in an exemplary embodiment, the first and second dimensions may be equal to each other but larger than the third dimension.

In an illustrative embodiment, a wheeled suitcase may include a housing having an internal cavity within six substantially planar exterior faces. In some embodiments, the six substantially planar exterior faces may include a front cavity-accessing face and a rear cavity-accessing face. The front and rear cavity-accessing faces each may have an openable access panel that, when opened, may provide substantially full-faced access to the internal cavity. The six substantially planar exterior faces may include two side faces. The six substantially planar exterior faces may include a bottom face and a top face. In some embodiments, the six substantially planar faces may define a cuboid having a first dimension, a second dimension, and a third dimension. In an exemplary embodiment, the first dimension may be greater than the second dimension and the second dimension may be greater than the third dimension. In some embodiments, the front and rear cavity-accessing faces each may have a height of the first dimension and a width of the second dimension. The side faces each may have a height of the first dimension and a width of the third dimension, for example. In some embodiments, the top and bottom faces each may have a height of the second dimension and a width of the third dimension.

In some embodiments, a wheeled suitcase may include a dynamic cavity divider separating the internal cavity into a front sub-cavity and a rear sub-cavity complementary to the front sub-cavity. The front sub-cavity may be accessible via a substantially full-faced door in the front cavity-accessing face. In some embodiments, the rear sub-cavity may be accessible via a substantially full-faced door in the rear cavity-accessing face. In an exemplary embodiment, the dynamic cavity divider may separate the internal cavity in response to relative forces presented to each of two sub-cavity-facing sides of the dynamic cavity divider.

In some embodiments, a wheeled suitcase may include two wheels attached to a bottom face. Some exemplary embodiments may include an inverted-U-shaped telescoping handle having two stems substantially parallel to the side faces. Some exemplary inverted-U-shaped telescoping handles may include a lateral handle substantially parallel to the top face of the suitcase. The lateral handle may connect each of the two stems at a handle end of each stem. In some embodiments, each of the stems may slidably couple to opposite ones of the two side faces at a telescoping end of each stem. The inverted-U-shaped telescoping handle may have an extended mode and a retracted mode. When in the retracted mode, the inverted-U-shaped telescoping handle may substantially frame the internal cavity with the stems proximate the side faces and the lateral handle proximate the top face. When in the extended mode, the lateral handle may project beyond the top face such that there is an air gap between the lateral handle and the top face.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. An article of luggage comprising:

an enclosure defining a primary chamber, the enclosure comprising:

a bottom panel;

an auxiliary access panel opposite the bottom panel;

a pair of side panels extending between the bottom panel and the auxiliary access panel, each of the side panels substantially parallel to a longitudinal axis;

a back panel extending between the pair of side panels and between the bottom panel and the auxiliary access panel; and, a front panel opposite the back panel and extending between the pair of side panels and between the bottom panel and the auxiliary access panel, wherein the front panel defines a first side of the enclosure and the auxiliary access panel defines a second side of the enclosure such that the first side is adjacent to the second side;

a primary access portal formed by the front panel and having an open state and a closed state, wherein, when in the open state, a first aperture is formed in the front panel to provide fluid communication into the primary chamber, and, when in the closed state, the primary access portal blocks fluid communication into the primary chamber through the first aperture;

an auxiliary access portal formed by the top panel and having an open state and a closed state, wherein, when in the open state, an auxiliary aperture is formed in the top panel to provide fluid communication into the primary chamber, and, when in the closed state, the primary access portal blocks fluid communication from the primary chamber through the auxiliary aperture;

a coupling interface disposed proximate a periphery of the auxiliary aperture when in the closed state and having a plurality of support points;

a dynamic volume receptacle (DVR) having a predetermined nominal capacity, and extending between a proximal end and a distal end, the DVR having a plurality of support members disposed proximate to the proximal end and configured to releasably couple to the plurality of support points when the DVR is inserted into the primary chamber through the auxiliary aperture, the DVR having an access opening at the proximal end, the access opening adapted to receive contents into an auxiliary chamber defined by the DVR; and, a capacity adjuster disposed at the distal end and configured to adjust the predetermined nominal capacity prior to the DVR being inserted into the primary chamber through the auxiliary aperture, wherein, when the DVR is inserted into the primary chamber through the auxiliary aperture and the plurality of support members are releasably coupled to the plurality of support points, the DVR separates contents inserted through the first aperture into the primary chamber and contents inserted into the auxiliary chamber through the access opening.

2. The article of luggage of claim 1, wherein the plurality of support points attach to at least one of the front panel, back panel, the pair of side panels and the auxiliary panel.

3. The article of luggage of claim 1, the DVR further comprising a distal opening at the distal end, wherein the capacity adjuster comprises a pair of fasteners adapted to seal the distal opening, and a pair of couplings, each coupling extending from at least one of the pair of fasteners, wherein when the pair of fasteners cooperate to seal the distal opening, the fasteners fold onto each other to modify the predetermined nominal capacity, wherein when a desired predetermined nominal capacity is reached, the pair of coupling releasably couple to each other to secure a folding to maintain the desired predetermined nominal capacity.

4. The article of luggage of claim 1, wherein the plurality of support points comprises a recessed ledge guide, and the plurality of support member comprises an engagement ridge to releasably couple to the recessed ledge guide when the DVR is inserted into the primary chamber through the auxiliary aperture.

5. The article of luggage of claim 1, wherein the plurality of support points comprises a plurality of receiving button snaps, and the plurality of support member comprises a plurality of push buttons to releasably couple to the plurality of receiving button snaps when the DVR is inserted into the primary chamber through the auxiliary aperture.

6. The article of luggage of claim 1, wherein the plurality of support points comprises a first flexible strip of interlocking projections, and the plurality of support member comprises a second flexible strip of interlocking projections to releasably couple to the first flexible strip of interlocking projections when the DVR is inserted into the primary chamber through the auxiliary aperture.

7. The article of luggage of claim 1, further comprising a tubular container mounted between the dynamic volume receptacle, the back panel and one of the side panels.

8. The article of luggage of claim 1, further comprising a compartment mounted to the back panel opposite the front panel, wherein the compartment has an elongated profile configured to receive a portable electronic device.

9. The article of luggage of claim 1, wherein the DVR comprises a fabric material.

10. The article of luggage of claim 1, wherein the DVR comprises a flexible polymer formed from a water-resistant material such that the DVR forms a moisture isolation boundary between contents inserted through the first aperture into the primary chamber and contents inserted into the DVR through the access opening when the auxiliary access portal is in an open state.

11. An article of luggage comprising:

an enclosure defining a primary chamber, the enclosure comprising:

a bottom panel;

an auxiliary access panel opposite the bottom panel;

a pair of side panels extending between the bottom panel and the auxiliary access panel, each of the side panels substantially parallel to a longitudinal axis;

a back panel extending between the pair of side panels and between the bottom panel and the auxiliary access panel; and, a front panel opposite the back panel and extending between the pair of side panels and between the bottom panel and the auxiliary access panel, wherein the front panel defines a first side of the enclosure and the auxiliary access panel defines a second side of the enclosure such that the first side is adjacent to the second side;

a primary access portal formed by the front panel and having an open state and a closed state, wherein, when in the open state, a first aperture is formed in the front panel to provide fluid communication into the primary chamber, and, when in the closed state, the primary access portal blocks fluid communication into the primary chamber through the first aperture;

an auxiliary access portal formed by the top panel and having an open state and a closed state, wherein, when in the open state, an auxiliary aperture is formed in the top panel to provide fluid communication into the primary chamber, and, when in the closed state, the primary access portal blocks fluid communication from the primary chamber through the auxiliary aperture;

a coupling interface disposed proximate a periphery of the auxiliary aperture when in the closed state and having a plurality of support points; and, a dynamic volume receptacle (DVR) having a predetermined nominal capacity, and extending between a proximal end and a distal end, the DVR having a plurality of support members disposed proximate to the proximal end and configured to releasably couple to the plurality of support points when the DVR is inserted into the primary chamber through the auxiliary aperture, the DVR having an access opening at the proximal end, the access opening adapted to receive contents into an auxiliary chamber defined by the DVR, wherein, when the DVR is inserted into the primary chamber through the auxiliary aperture and the plurality of support members are releasably coupled to the plurality of support points, the DVR separates contents inserted through the first aperture into the primary chamber and contents inserted into the auxiliary chamber through the access opening.

12. The article of luggage of claim 11, wherein the plurality of support points attach to at least one of the front panel, back panel, the pair of side panels and the auxiliary panel.

13. The article of luggage of claim 11, wherein the plurality of support points comprises a recessed ledge guide, and the plurality of support member comprises an engagement ridge to releasably couple to the recessed ledge guide when the DVR is inserted into the primary chamber through the auxiliary aperture.

14. The article of luggage of claim 11, wherein the DVR comprises a flexible polymer formed from a water-resistant material such that the DVR forms a moisture isolation boundary between contents inserted through the first aperture into the primary chamber and contents inserted into the DVR through the access opening when the auxiliary access portal is in an open state.

15. The article of luggage of claim 11, further comprising a tubular container mounted between the dynamic volume receptacle, the back panel and one of the side panels.

16. The article of luggage of claim 11, further comprising a compartment mounted to the back panel opposite the front panel, wherein the compartment has an elongated profile configured to receive a portable electronic device.

17. The article of luggage of claim 11, wherein the DVR comprises a fabric material.

18. An article of luggage comprising:

an enclosure defining a primary chamber, the enclosure comprising:

a bottom panel;

an auxiliary access panel opposite the bottom panel;

a pair of side panels extending between the bottom panel and the auxiliary access panel, each of the side panels substantially parallel to a longitudinal axis;

a back panel extending between the pair of side panels and between the bottom panel and the auxiliary access panel; and, a front panel opposite the back panel and extending between the pair of side panels and between the bottom panel and the auxiliary access panel, wherein the front panel defines a first side of the enclosure and the auxiliary access panel defines a second side of the enclosure such that the first side is adjacent to the second side;

a primary access portal formed by the front panel and having an open state and a closed state, wherein, when in the open state, a first aperture is formed in the front panel to provide fluid communication into the primary chamber, and, when in the closed state, the primary access portal blocks fluid communication into the primary chamber through the first aperture;

an auxiliary access portal formed by the top panel and having an open state and a closed state, wherein, when in the open state, an auxiliary aperture is formed in the top panel to provide fluid communication into the primary chamber, and, when in the closed state, the primary access portal blocks fluid communication from the primary chamber through the auxiliary aperture;

means for coupling at a plurality of support points;

a dynamic volume receptacle (DVR) having a predetermined nominal capacity, and extending between a proximal end and a distal end, the DVR having a plurality of support members disposed proximate to the proximal end and configured to releasably couple to the coupling means when the DVR is inserted into the primary chamber through the auxiliary aperture, the DVR having an access opening at the proximal end, the access opening adapted to receive contents into an auxiliary chamber defined by the DVR; and, wherein, when the DVR is inserted into the primary chamber through the auxiliary aperture and the plurality of support members are releasably coupled to the coupling means, the DVR separates contents inserted through the first aperture into the primary chamber and contents inserted into the auxiliary chamber through the access opening.

19. The article of luggage of claim 18, further comprising means for adjusting the predetermined nominal capacity prior to the DVR being inserted into the primary chamber through the auxiliary aperture.

20. The article of luggage of claim 18, wherein the coupling means comprises a recessed ledge guide, and the plurality of support member comprises an engagement ridge to releasably couple to the recessed ledge guide when the DVR is inserted into the primary chamber through the auxiliary aperture.

* * * * *